United States Patent [19]

Kaufmann

[11] 4,036,263

[45] July 19, 1977

[54] HEDDLE FRAME

[75] Inventor: Frank H. Kaufmann, Greenville, S.C.

[73] Assignee: Steel Heddle Manufacturing Company, Greenville, S.C.

[21] Appl. No.: 696,127

[22] Filed: June 14, 1976

[51] Int. Cl.[2] ..... D03C 9/06

[52] U.S. Cl. ..... 139/91

[58] Field of Search ..... 139/91, 92, 57, 55, 139/82

[56] References Cited

U.S. PATENT DOCUMENTS

| | | | |
|---|---|---|---|
| 3,074,438 | 1/1963 | Svaty | 139/91 |
| 3,154,109 | 10/1964 | Kaufmann | 139/92 |
| 3,683,970 | 8/1972 | Wicker | 139/91 |
| 3,696,842 | 10/1972 | Pfarrwaller | 139/91 |

FOREIGN PATENT DOCUMENTS

| | | | |
|---|---|---|---|
| 1,181,962 | 1/1959 | France | 139/92 |
| 917,780 | 9/1954 | Germany | 139/92 |
| 451,040 | 5/1968 | Switzerland | 139/91 |
| 465,526 | 12/1968 | Switzerland | 139/57 |

*Primary Examiner*—James Kee Chi

*Attorney, Agent, or Firm*—Zachary T. Wobensmith, 2nd; Zachary T. Wobensmith, III

[57] ABSTRACT

A heddle frame is disclosed for use with weaving machines such as Sulzer or others which includes an extruded upper frame rail and an extruded lower frame rail connected at their ends by side struts, the upper and lower frame rails having heddle rods affixed thereto for carrying heddles therebetween, the lower frame rail having a push rod block or bushing therewithin which is engaged from below by a push rod. The push rod block or bushing is carried in the lower frame rail near its neutral axis.

5 Claims, 3 Drawing Figures

FIG. 1
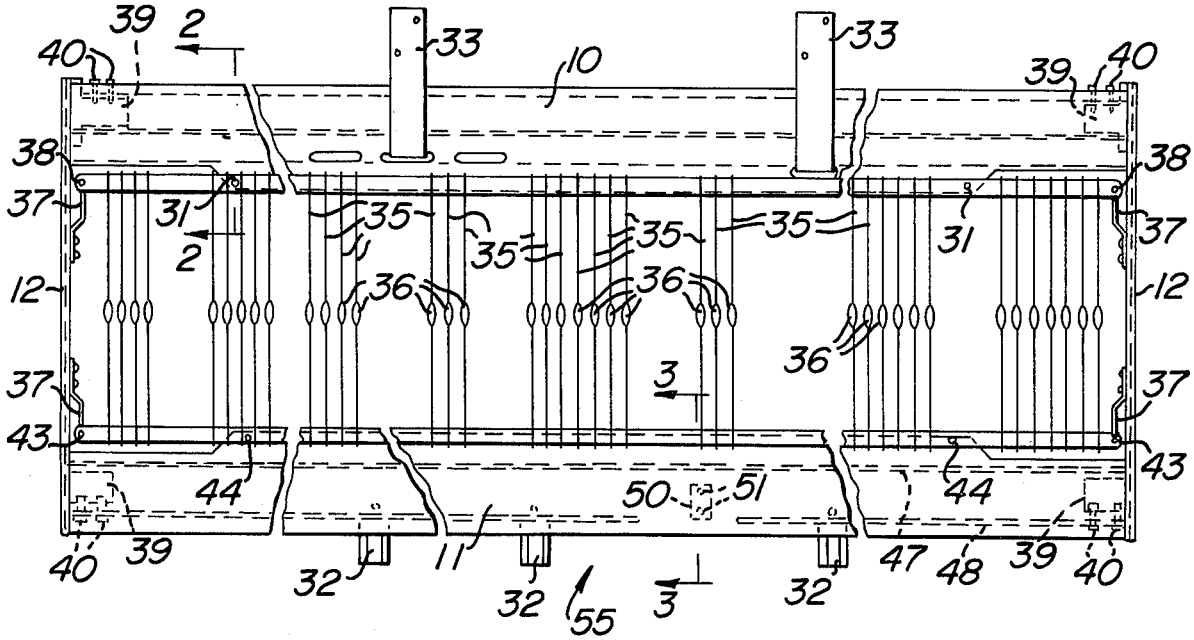
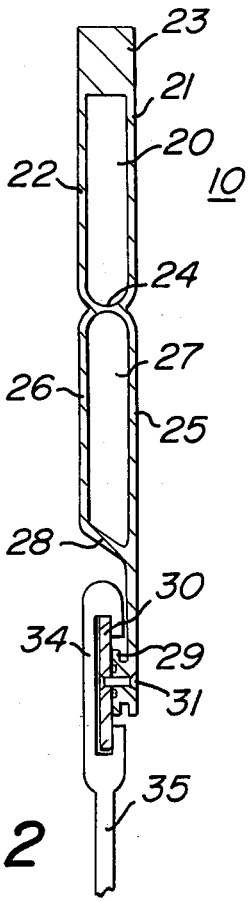
FIG. 2
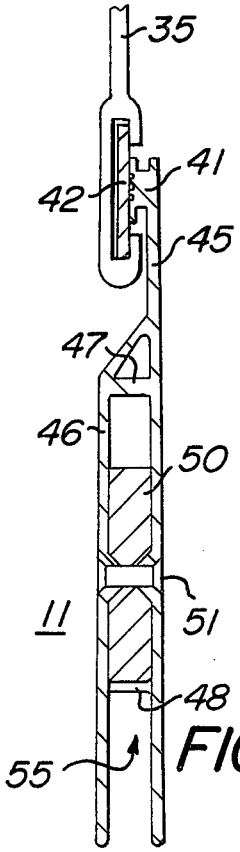
FIG. 3

HEDDLE FRAME

BACKGROUND OF THE INVENTION

1. Field of the Invention

A heddle frame is provided of the type which is actuated by a push rod engaging a push rod block carried by the frame.

2. Description of the Prior Art

In certain of the currently available weaving machines the heddle frames are actuated from below by a push rod assembly rather than from above by harness equipment. These machines operate at high speeds and the heddles must change direction violently and quickly.

The forces imparted to the heddle frames by the push rods are concentrated at the attachment points of the push rod blocks or bushings to the frame and such forces tend to bend the frame section at this point causing stresses which result in its eventual failure. Examples of such frame construction are shown in the U.S. Patents to R. Rossman, U.S. Pat. No. 2,069,330, John J. Kaufmann, U.S. Pat. No. 3,154,108 and Frank. H. Kaufmann, U.S. Pat. No. 3,155,118.

In these patents, in order for the push rod block to be assembled and for the push rod assembly of the weaving equipment to have access to the block or bushing, a slot is made in the lower wall of the frame rail. The opening causes a weakness in the rail and is usually the point at which frame failure begins.

The heddle frame of my invention is of lightweight construction, does not suffer from the defects of the prior art structures and has many positive advantages.

SUMMARY OF THE INVENTION

This invention relates to a heddle frame of the all metal type which includes top and bottom frame rails fastened together at their ends by side struts, the rails having heddle rods affixed thereto to support the heddles and the lower rail having push rod blocks or bushings carried therein.

The principal object of the invention is to provide a heddle frame which is simple and inexpensive to construct but sturdy and of long service life.

A further object of the invention is to provide a heddle frame which is light in weight.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 1 is a front elevational view of a heddle frame in accordance with the invention;

FIG. 2 is a vertical sectional view, enlarged, taken approximately on the line 2—2 of FIG. 1, and FIG. 3 is a vertical sectional view, enlarged, taken approximately on the line 3—3 of FIG. 1.

It should, of course, be understood that the description and drawings herein are illustrative merely and that various modifications and changes can be made in the structure disclosed without departing from the spirit of the invention.

Like nemerals refer to like parts throughout the several views.

DESCRIPTION OF THE PREFERRED EMBODIMENT

Referring now more particularly to the drawings and the heddle frame there illustrated has top and bottom rails 10 and 11 connected at their ends by side struts 12 of any desired construction.

The top rail 10 as illustrated in detail in FIG. 2 is an extrusion, preferably of aluminum, but other light weight metals including aluminum alloys are suitable.

The top rail 10 includes an upper box like section 20 with side walls 21 and 22, top rib 23 and central wall 24. The cnetral wall 24 has side walls 25 and 26 of lower box like section 27 integral therewith and connected by wall 28. The side wall 26 extends down below walls 25 and 28 and has an offset section 29 perpendicularly oriented thereto to which a heddle rod 30 is connected such as by rivets 31. The heddle rod 30 carries a plurality of heddles 35 with warp eyes 36 and eyes 34 at both ends slidable on the rods 30 and retained on rod 30 by spring hooks 37 carried on struts 12 engaged in apertures 38 in the ends of the heddle rod.

The struts 12 have extensions 39 extending into the ends of the rail 10 with cap screws 40 through the rib 23 into the extensions 39 retaining the frame together.

The rails 10 and 11 can have outer nose guides 33 and inner nose guides 32 carried thereby.

Referring now to FIG. 3, the lower frame rail 11 is formed as an extrusion, preferably of aluminum but other suitable light weight materials may be used if desired. The rail 11 has an offset section 41 with a heddle rod 42 secured thereto such as by a suitable adhesive or rivets 44 and which supports the heddles 35 at their end eyes 34 which heddles are retained on rod 42 by spring hooks 37 from struts 12 engaged in apertures 43 at the ends of the heddle rod.

The lower rail 11 has a rear plate 45 perpendicularly attached to the section 41 which forms one side of the rail 11 with a front plate 46 forming the other side connected thereto by walls 47 and 48. The wall 48 spans the plates 45 and 46 about 1/3 the distance above the lower terminus of the plates forming a box-like portion between the walls 47 and 48.

The struts 12 have their extensions 39 extending into the ends of rail 11 with cap screws 56 extending through wall 48 and into extensions 39.

A push rod block 50 is provided within the walls 45, 46, and 47 and with rivets 51, if employed in place of a suitable adhesive, extending through block 50 and plates 45 and 46. The wall 48 is provided with a slot 55 therein to permit access of a push rod assembly (not shown) to actuate the heddle frame as desired.

The block 50 is of well known type suitable for engagement by a push rod assembly (not shown) from the weaving equipment.

It will thus be seen that a heddle frame has been provided with which the objects of the invention are achieved.

I claim:

1. In a heddle frame having top and bottom rails connected at their ends by struts, said bottom rail comprising a rear plate having a continuous and uninterrupted bottom edge, a front plate having a continuous and uninterrupted bottom edge, an upper horrizontal wall connecting said front and rear plates, a lower horizontal wall connecting said front and rear plates and spaced above the edges of said plates, said plates and said walls providing a box like section, a block member for push rod engagement in said section having its upper margin spaced downwardly from said upper horizontal wall and in the proximity of the neutral axis of the section and retained therein, said lower horizontal wall having portions terminated in spaced relation to said block member for push rod access to said block member.

2. A heddle frame as defined in claim 1 in which said top and bottom rails are extrusions.

3. A heddle frame as defined in claim 1 in which said top rail and said bottom rail have portions with heddle rods attached thereto.

4. A heddle frame as defined in claim 1 in which said member for push rod engagement is adhesively secured in said rail.

5. A heddle frame as defined in claim 1 in which said member for push rod engagement is secured in said rail by rivet means.

* * * * *

UNITED STATES PATENT OFFICE

CERTIFICATE OF CORRECTION

Patent No. 4,036,263 Dated July 19, 1977

Inventor(s) Frank H. Kaufmann

It is certified that error appears in the above-identified patent and that said Letters Patent are hereby corrected as shown below:

Column 2,

Line 13, after "The", "cnetral" should be - central -

Line 19, after "and" and before "eyes" insert - end -

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*